United States Patent [19]

Anderson et al.

[11] 4,023,223

[45] May 17, 1977

[54] PROTECTIVE CLOTHING

[75] Inventors: Alexander Adam Anderson; Douglas Martin Gallacher, both of Aberdeen, Scotland

[73] Assignee: Cosalt Limited, Grimsby, England

[22] Filed: Mar. 29, 1976

[21] Appl. No.: 671,050

[30] Foreign Application Priority Data

Apr. 2, 1975 United Kingdom ..... 13457/75

[52] U.S. Cl. ..... 9/330; 2/2.1 A; 2/79; 2/82

[51] Int. Cl.[2] ..... B63C 9/08

[58] Field of Search ..... 2/82, 81, 87, 79, 2.1 A; 9/330, 331, 329

[56] References Cited

UNITED STATES PATENTS

| | | | |
|---|---|---|---|
| 1,271,017 | 7/1918 | Cassidy | 2/82 X |
| 2,181,159 | 11/1939 | Temple | 9/330 |
| 2,305,605 | 12/1942 | Craig et al. | 2/82 X |
| 2,543,317 | 2/1951 | Hammond | 2/82 X |
| 2,655,663 | 10/1953 | Hoagland | 2/82 X |

FOREIGN PATENTS OR APPLICATIONS

| | | | |
|---|---|---|---|
| 1,948,360 | 4/1970 | Germany | 9/330 |

*Primary Examiner*—H. Hampton Hunter
*Attorney, Agent, or Firm*—Larson, Taylor & Hinds

[57] ABSTRACT

An emergency overall suit, for protection of a person against exposure in water comprises a single garment with inner and outer layers, water-excluding seals at the ankle, wrist and neck portions and small vents at the extremities of the legs and arms of the suit to admit air and water to the space between the layers.

8 Claims, 8 Drawing Figures

PROTECTIVE CLOTHING

DESCRIPTION

Figure 1:
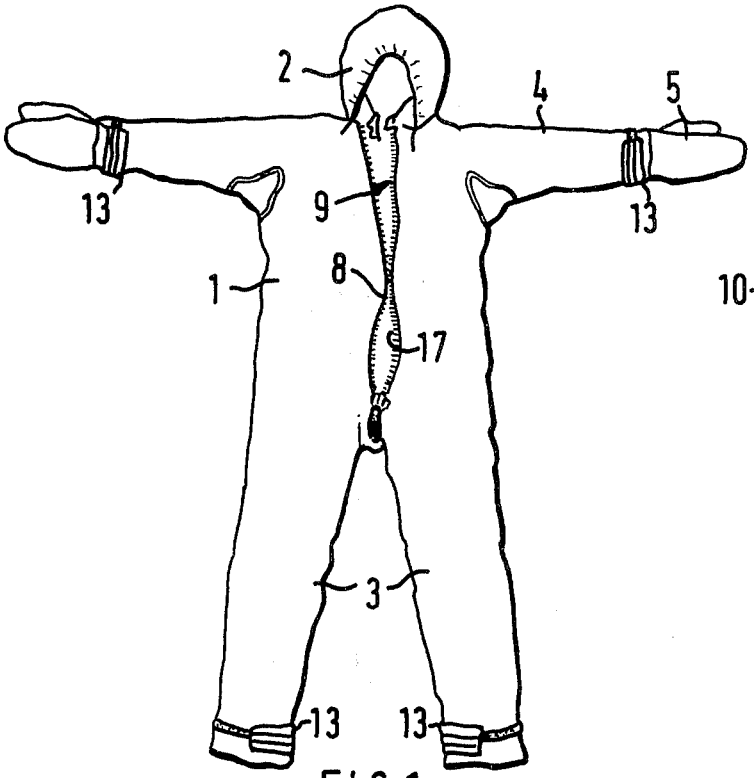

This invention relates to protective clothing and provides an emergency overall suit designed to protect the wearer against effects of immersion in cold water, such as through mishap at sea, by conserving body heat and thus avoiding rapid reduction of body temperature.

Investigation has shown that in practice it is impossible to provide an emergency overall suit, except of course for an enclosed diving suit, which will keep the wearer completely dry when plunged into water. Further, insulating padding intended to keep a wearer warm may be liable, by its very nature, to absorb a large amount of water and consequently absorb body heat to a corresponding extent. If a padded suit becomes sodden, the mobility of the wear may also be seriously reduced in emerging from the water.

The present invention is based upon the concept of providing a non-absorbent, lightweight, overall suit which will protect the wearer against shock exposure to cold water on immersion and then permit the ingress of water to the suit at such locations and rate that retention of a layer of air and moisture is promoted to provide thermal insulation for the wearer.

It has been established that, if the ingress of water to a suit can be suitably restricted so as to establish a relatively static layer of air and moisture around the body, the rate of heat loss is significantly reduced and the generation of body heat is sufficient to maintain a survival temperature for a surprisingly long time. It will be appreciated that, as compared with a survival period of perhaps only ten minutes without protection in the North Atlantic in winter, protection against the effects of cold for even only a further ten minutes materially improve the possibility of rescue.

The emergency overall suit of the present invention is of a known kind insofar as it consists of a single garment, having a trunk portion, with an access opening closed by a watertight fastening, to enable a wearer to get into the suit, and a hood, legs and arms, the suit being of textile material in two layers, respectively an inner heat-insulating layer and an outer waterproof layer.

According to the invention, an emergency overall suit of the above kind has the following features in combination:

a. the inner and outer layers are intersecured by seams at the ankles, wrists, neck and access opening but their opposed inside surfaces are otherwise separable to provide between them an air space;

b. at each ankle and wrist and at the neck there is an inner encircling sealing band and means to hold the sealing band comfortably tight around the body of the wearer; and c. at each extremity of the legs and arms of the suit, small vents are provided to allow for admission of air and water to the space between the inner and outer layers of the suit.

Additional features of a preferred embodiment of the invention are:

d. the inner layer is heat-reflective, preferably by virtue of metallised inner surface, to reflect body heat and is substantially waterproof but breathable, i.e. slowly permeable by air;

e. mitts for wearer's hands are attached to the wrist portions of the suit and have hand-access openings, with closing means, so that the wearer can have freedom for use of hands and protect them when required; and f. in-built buoyancy may optionally be provided by an inter-lining, of buoyant but non-absorbent sheet material, between the inner and outer layers of the suit over the area of the upper part of the trunk portion, in the chest, over the shoulders and around the back of the neck.

Figure 3:
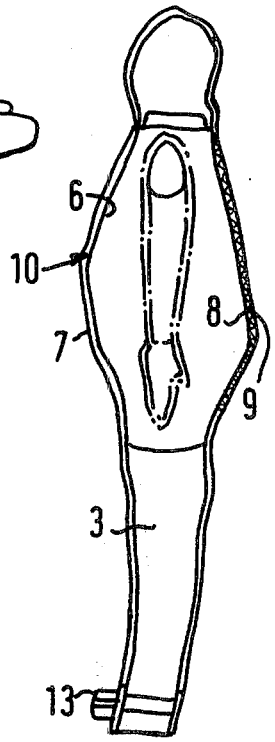
Figure 2:
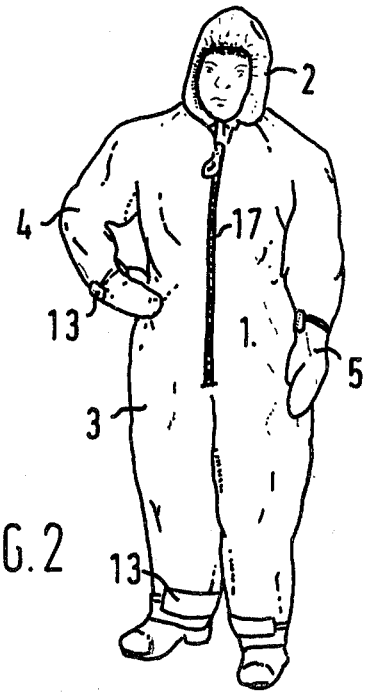
Figure 4:
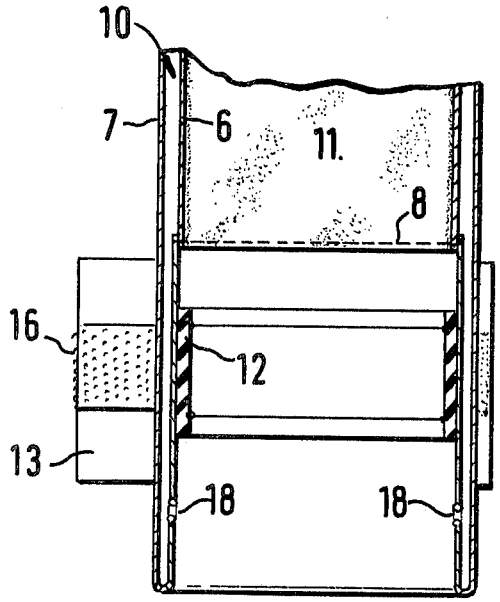
Figure 5:
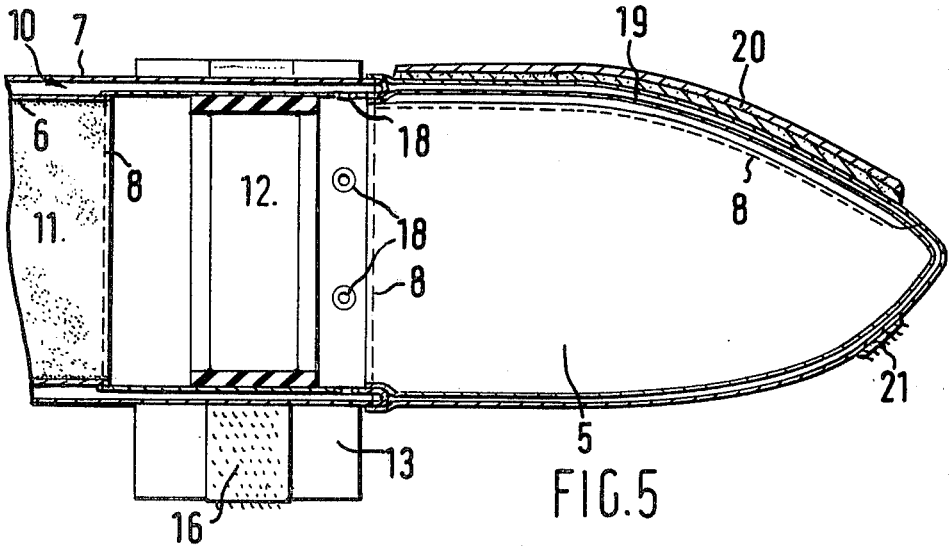
Figure 7:
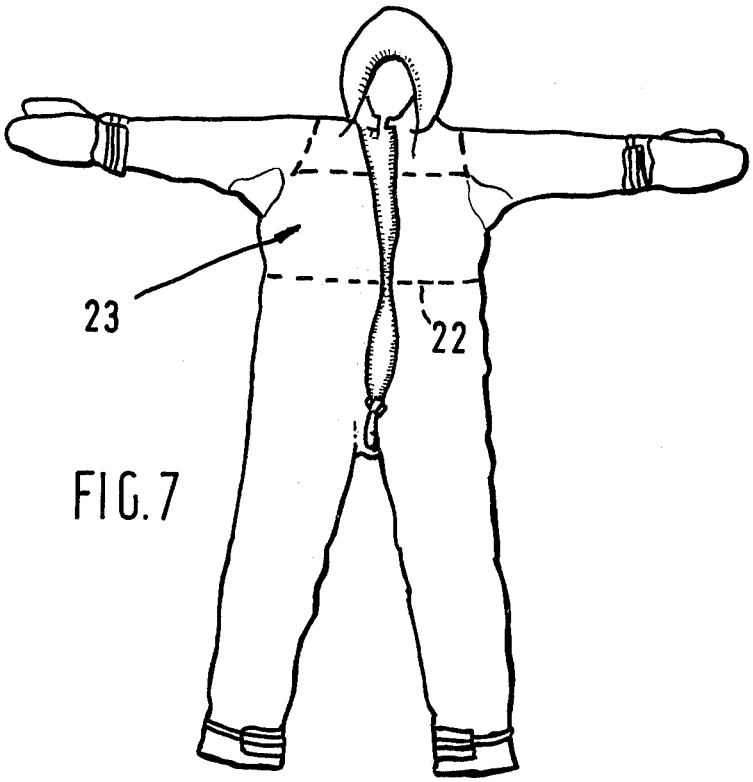
Figure 8:
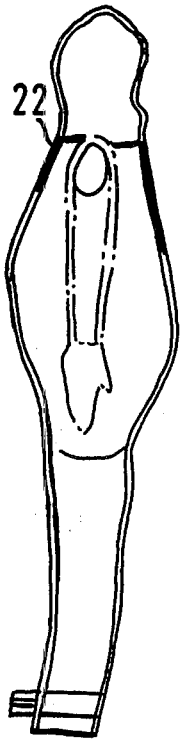
Figure 6:
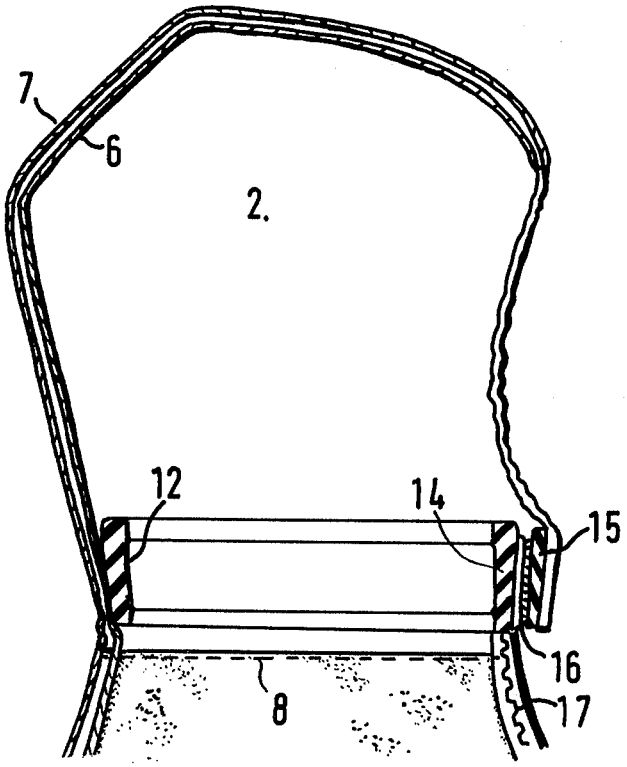

Two embodiments of the invention are illustrated, by way of example, on the accompanying drawings, in which:

FIG. 1 is a front view of a suit intended to be worn with a separate buoyancy aid, such as an inflatable life-jacket, such as by air passengers conveyed by helicopter to or from an oil rig or other off-shore installation, FIG. 2 is a pictorial view of the suit of FIG. 1 on a wearer, FIG. 3 is a somewhat diagrammatic sectional side view of the suit of FIG. 1, FIGS. 4, 5 and 6 are sectional views, on a larger scale, of the ankle, wrist and mitt, and neck and hood parts of the suit of FIG. 1, and FIGS. 7 and 8 are views similar to FIGS. 1 and 3 but showing another embodiment of the suit with in-built buoyancy, suitable for example for wear by trawler men or other mariners.

The emergency overall suit as shown by FIGS. 1 to 6 is a single garment comprising a trunk portion 1, a hood 2, legs 3 and arms 4, with attached mitts 5.

The material of the suit is woven textile material in two complete layers, an inner layer 6 and an outer layer 7, which are intersecured by seams 8 at the wrists, ankles, neck and around a front access opening 9. The layers 6 and 7 are however separable substantially throughout their opposed surfaces to form between them a space 10 for the free passage of air. The seams 8 are stitched and sealed, such as by taping or doping.

The outer layer 7 is made waterproof, as far as possible, being for example of siliconized nylon proofed with polyurethane. Preferably the colour is bright, especially fluorescent orange, and a radar-reflective patch or area may be provided on the hood, shoulders or upper trunk portion.

The inner layer 6 is of heat-insulating and substantially waterproof woven textile material but is preferably of such texture that it is breathable, i.e. slowly permeable by air. Heat retention is preferably promoted by a metallised inner surface 11, such as of aluminium applied as a dope or by vacuum deposition, to reflect body heat.

At each ankle (FIG. 4) and wrist cuff (FIG. 5) and at the neck (FIG. 6) of the suit there is provided an inner encircling sealing band 12, such as of synthetic rubber or other resilient closed-cell foam. At each ankle and wrist cuff an outer constricting strap 13 is provided to hold the respective cuff and sealing band 12 comfortably tight around the wearer. At the neck the ends, 14 and 15, of the sealing band 12 are arranged to overlap and be inter-secured within the suit. For the cuff straps and neckband, preferred fasteners 16 are of the face-to-face, bristle hook and loop type, such as Velcro (Trade Mark). It is not intended that the sealing bands 12 shall preclude ingress of water but they can reduce the rate of ingress to that which body heat will cope with for a considerable period.

To enable a wearer to don the suit over ordinary clothing, the front of the trunk of the suit has the full-length access opening 9 which can be closed up to beneath the chin by an edge-to-edge fastening 17. The preferred fastening is of the sliding clasp waterproof type commercially available and as used on wet-suits for divers.

At each extremity of the legs and arms of the suit, beyond the sealing ands 12 and straps 13, vents 18 are provided, such as small eyelitted holes, to give access for air and water to the space 10 between the outer and inner layers of the suit. This is a very important feature of the invention which ensures that, when a person wearing the suit is plunged into water, only a small amount of water can preferentially seep in at the wrists and ankles to trap air between the layers of the suit. As water accumulates at the ends of the arms and legs of the suit, the trapped air in the space 10 builds up pressure resistance which reduces the rate of ingress of water and preserves a substantially static thermal insulating layer over the greater part of the wearer's body. By permitting ingress of water at the extremities, particularly at the ankles, the vents 16 ensure that buoyancy due to trapped air is promoted towards the upper part of the body which thus tends to assume the best survival attitude, i.e. floating upwardly inclined at 45° face upwards at the surface of the water. It should here be mentioned as a reminder that the suit, as so far described, is intended to be worn with a life-jacket or other buoyancy aid. On emergence from the water and loosening of the straps 13, the vents 18 permit drainage of water from between the suit layers and thus promote mobility for the wearer.

The mitts 5 are of the same inner and outer layer construction as the remainder of the suit, are made in with, or permanently secured to, the wrist cuffs and have each at the back a hand opening at 19, to enable the mitts to be turned back, conveniently a longitudinal overlapped fly opening with a face-to-face strip fastening 20. By providing a fastening patch 21 on the mitts, and a corresponding patch (not shown) on the sleeve, the mitts can be held turned back out of the way of the wearer's hands.

The suit shown by FIGS. 7 and 8 is similar to that of FIGS. 1 to 6 but is provided with in-built buoyancy, to supplement or serve instead of a life-jacket. For this purpose, an additional layer or inter-lining 22 of buoyant but non-absorbent sheet material, such as a rubber or other flexible closed-cell foam, is incorporated between the inner and outer layers of the suit over the area, indicated at 23 on FIG. 7, of the upper part of the trunk portion, in the chest, over the shoulders and around the back of the neck. Such a buoyant interlining 22 will promote flotation of the wearer in the appropriate upwardly-inclined attitude.

We claim:

1. An emergency overall suit comprising a single garment having a trunk portion, with an access opening closed by a watertight fastening, a hood, legs and arms, the suit being of textile material in two layers, respectively an inner heat-insulating layer and an outer waterproof layer, the suit also comprising the following features in combination:

a. the inner layer and outer layer are intersecured, by seams at the ankles, wrists, neck and access opening, but their opposed inside surfaces are otherwise separable to provide between them an air space;

b. at each ankle and wrist and at the neck there is an inner encircling sealing band and means to hold the sealing band comfortably tight around the body of the wearer; and c. at each extremity of the legs and arms of the suit, small vents are provided to allow for admission of air and water to the space between the inner and outer layers of the suit.

2. An emergency overall suit according to claim 1, in which the inner layer is made heat-reflective, by a metallised inner surface, and is substantially waterproof but slowly permeable by air.

3. An emergency overall suit according to claim 2, in which mitts are attached to the wrist portions of the suit and have hand-access openings with closing means.

4. An emergency overall suit according to claim 3, in which the sealing bands are of resilient, closed-cell, foam material and the means for holding them tight comprise outer constricting straps with face-to-face fasteners.

5. An emergency overall suit according to claim 1, in which in-built buoyancy is provided by an inter-lining of buoyant but non-absorbent sheet material between the inner and outer layers of the suit over the area of the upper part of the trunk, in the chest, over the shoulders and around the back of the neck of the suit.

6. An emergency overall suit according to claim 1, in which mitts are attached to the wrist portions of the suit and have hand-access openings with closing means.

7. An emergency overall suit according to claim 1, in which the sealing bands are of resilient, closed-cell, foam material and the means for holding them tight comprise outer constricting straps with face-to-face fasteners.

8. An emergency overall suit according to claim 7, in which in-built buoyancy is provided by an inter-lining of buoyant but non-absorbent sheet material between the inner and outer layers over the area of the upper part of the trunk, in the chest, over the shoulders and around the back of the neck.

* * * * *